United States Patent [19]

Schoppe et al.

[11] 4,135,804

[45] Jan. 23, 1979

[54] REGISTRATION SYSTEM FOR A REPRODUCING MACHINE

[75] Inventors: Wayne F. Schoppe, Webster; Bruce A. Winship, Rochester, both of N.Y.

[73] Assignee: Xerox Corporation, Stamford, Conn.

[21] Appl. No.: 794,767

[22] Filed: May 9, 1977

[51] Int. Cl.[2] ..... G03G 15/00

[52] U.S. Cl. ..... 355/3 SH; 271/229; 271/245

[58] Field of Search ..... 271/245, 246, 229, 230; 355/3 SH

[56] References Cited

U.S. PATENT DOCUMENTS

| | | | |
|---|---|---|---|
| 1,560,570 | 11/1925 | Hammersmith | 271/229 |
| 2,246,508 | 6/1941 | Davidson | 271/53 X |
| 3,963,339 | 6/1976 | Taylor et al. | 271/10 X |

*Primary Examiner*—William M. Shoop

[57] ABSTRACT

A registration apparatus for a reproducing machine includes a resilient means which cooperates with a stop member to control the path of a sheet as it is intercepted by the stop member. Preferably the resilient member also operates to strip the sheet from the stop member as the stop member moves out of the sheet path.

8 Claims, 3 Drawing Figures

REGISTRATION SYSTEM FOR A REPRODUCING MACHINE

CROSS REFERENCE TO RELATED APPLICATION

U.S. application Ser. No. 662,283, filed Mar. 1, 1976, to Taylor, et al. for a stack elevating apparatus, now U.S. Pat. No. 4,033,578.

BACKGROUND OF THE INVENTION

This invention relates to a registration apparatus for a reproducing machine. Registration is provided when a sheet which is being fed along a desired path is intercepted by a stop member to properly position it along the path in a timed relationship with an imaging means for applying the image to it.

PRIOR ART STATEMENT

It is well known in the sheet feeding art to employ a registration device in order to insure that a copy sheet when fed to an imaging station is received therein in a properly timed sequence so that the image applied thereto, is appropriately positioned on the sheet. Various approaches have been used to accomplish this registration function. Pivoting type registration gates have found wide application as stop members for registering a sheet in a sheet feed path as evidenced by the following U.S. Pat. Nos. 672,529; 2,246,508; 3,015,485; 3,281,144; 3,298,682; and 3,512,923.

A particularly useful pivoting registration member is described in U.S. Pat. No. 3,963,339 to Taylor et al.. Taylor et al. disclose an apparatus wherein sheets fed from a supply in a reproducing machine are forwarded against a movable stop and buckled. A chute forming member movable with the stop provides space for buckling when the stop is blocking sheet movement and aids in flattening the buckle when the stop is not blocking sheet movement. The present invention preferably comprises an improvement in the apparatus as described by Taylor, et al., in that means are provided for controlling the path of the sheet as it is intercepted by the stop and for assisting in stripping the sheet from the member as it is withdrawn from its sheet blocking position.

Various devices are known in the art for aiding in stripping a sheet from a sheet blocking member. In U.S. Pat. No. 3,416,863 to Ralston, a copy sheet and an original document are fed in overlapping relationship to a separator. The separator is designed to take hold of the advanced end of the copy sheet and pull it away from the original document. This causes the two sheets to enter two separate paths for further processing. The separator includes a swinging hook arm which acts as a passive diverter. The arm is pushed by the sheet and pivoted about its center as it swings pulling the trapped end of the sheet along a curved path. The separator also includes a stripping arm which operates in conjunction with the separator arm to sweep outwardly toward the end of the hook on the separator arm and push the trapped copy sheet off the separator arm at a proper location.

U.S. Pat. No. 3,343,834 to Mazzio is also directed to separating superimposed sheets. A sheet handling mechanism is described which comprises a means for propelling first and second superimposed sheets along a path with the first sheet projecting slightly ahead of the second sheet. A separating finger projects into the path and includes a projection or hook for temporarily catching the leading edge of the first sheet whereby the advancing movement of that sheet causes the finger to swing out of the path. A stationary stripper operates to dislodge the first sheet from the projection on the finger at an appropriate position whereby the first and second sheets pass along first and second paths.

Both the Ralston and Mazzio patents describe separating and stripping system which are arranged to separate a document and a copy sheet after an imaging operation has taken place. In contrast the registration apparatuses in accordance with the present invention are intended for use prior to imaging and serve to properly align the copy sheet with the imaging device so that the image will be properly located on the copy sheet.

SUMMARY OF THE INVENTION

In accordance with this invention a registration apparatus for a reproducing machine includes a resilient means which cooperates with a stop member to control the path of the sheet as it is intercepted by the stop member. Preferably a means is provided which cooperates with the stop member to control the path as above as well as to strip the sheet from the stop member as the stop member moves out of the sheet path.

A reproducing apparatus in accordance with this invention comprises means for forming an image on a copy sheet. Means for feeding or propelling a sheet along a path to the image forming means. Means for registering the copy sheet with respect to the image forming means. The registering means comprises a stop member for intercepting an edge of the sheet and means for moving the stop member either into sheet blocking relationship in the path or out of sheet blocking relationship. A guide member for supporting the sheet is positioned along the path adjacent the stop means. In accordance with this invention the registration means is uniquely improved by providing a resilient means for urging the sheet against the guide member as it is intercepted by the stop means. This provides improved consistency with respect to the position of the edge of the sheet as it is intercepted by the stop means, and, therefore, improved registration of the sheet with respect to the image forming means.

In a preferred embodiment, the resilient means also operates to strip a sheet from the stop member as it is moved out of its sheet blocking relationship. Preferably, the stop member comprises a pivotally supported registration gate.

Accordingly, it is an object of this invention to provide an improved registration apparatus for a reproducing machine.

It is a further object of this invention to provide an apparatus as above including improved means for controlling the path of a sheet as it is intercepted by a stop member.

It is yet a further object of this invention to provide an apparatus as above wherein the controlling means also strips the sheet from the stop member.

It is a still further object of this invention to provide a reproducing apparatus employing the registration apparatus as above.

These and other objects will become apparent from the following description and drawings.

DETAILED DESCRIPTION OF THE PREFERRED EMBODIMENTS

Figure 1:
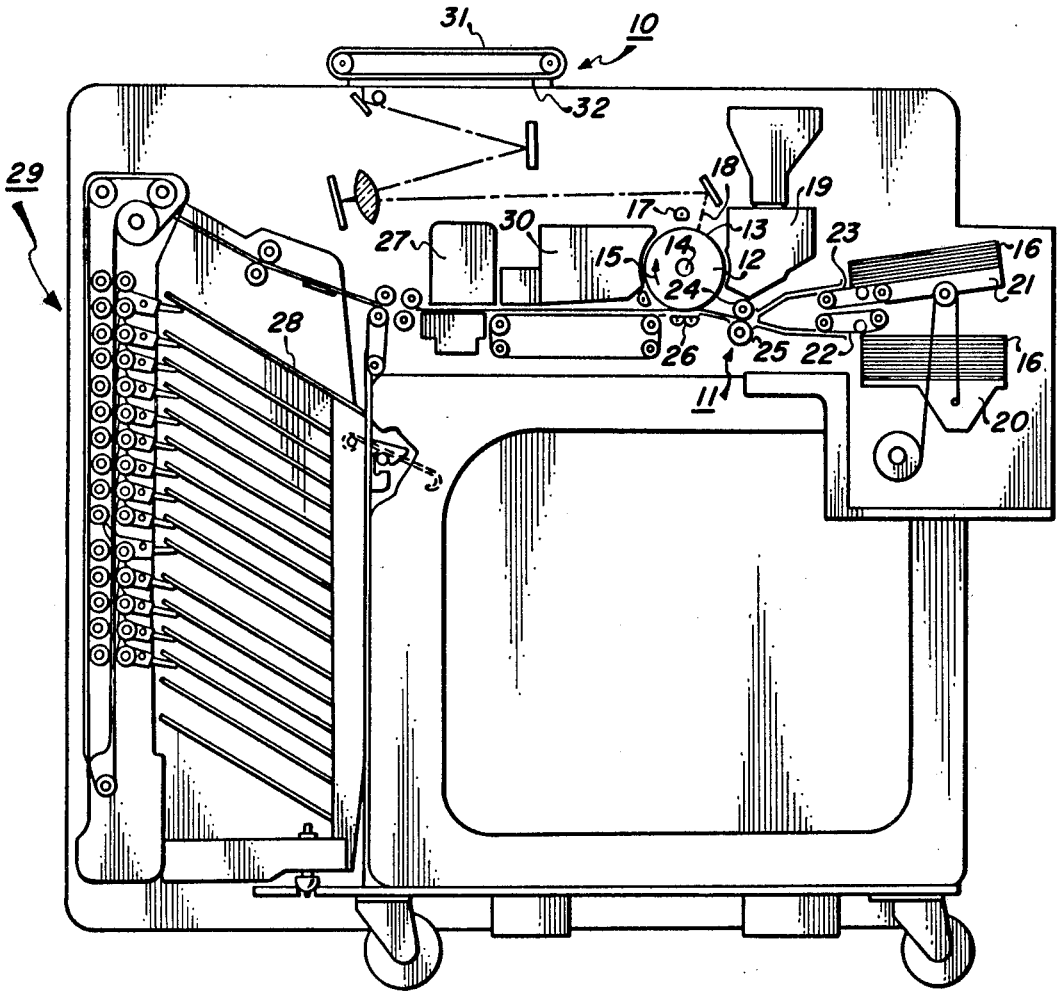
FIG. 1 is a schematic representation of a reproducing apparatus employing a registration mechanism in accordance with this invention.

Referring now to FIG. 1 there is shown by way of example an automatic xerographic reproducing machine 10 which includes a registration apparatus 11 of the present invention. The reproducing machine 10 depicted in FIG. 1 illustrates the various components utilized therein for producing copies from an original. Although the apparatus 11 of the present invention is particularly well adapted for use in an automatic xerographic reproducing machine 10, it should become evident from the following description that it is equally well suited for use in a wide variety of processing system including other electrostatographic systems and it is not necessarily limited in its application to the particular embodiment of embodiments shown herein.

The reproducing machine 10 illustrated in FIG. 1 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophogography* by Schaffert, and *Xerography and Related Processes* by Dessauer and Clark, both published in 1965 by the Focal Press.

Initially, the drum 12 moves the photoconductive surface 13 through a charging station 17. In the charging station 17, an electrostatic charge is placed uniformly over the photoconductive surface 13 preparatory to imaging. The charging may be provided by a corona generating device of the type described in U.S. Pat. No. 2,836,726, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,832,057, issued to Shogren in 1974. After exposure drum 12 rotates the electrostatic latent image recorded on the photoconductive surface 13 to development station 19 wherein a conventional developer mix is applied to the photoconductive surface 13 of the drum 12 rendering the latent image visible. A suitable development station is disclosed in U.S. Pat. No. 3,707,947, issued to Reichart in 1973. That patent describes a magnetic brush development system utilizing a magnetizable developer mix having coarse ferromagnetic carrier granules and toner colorant particles. The developer mix is brought through a directional flux field to form a brush thereof. The electrostatic latent image recorded on the photoconductive surface 13 is developed by bringing the brush of developer mix into contact therewith.

Sheets 16 of final support material are supported in a stack arrangement on an elevating stack support tray 20 or in an auxiliary tray 21. Sheet separators 22 and 23 selectively feed individual sheets from their respective stacks to the registration system 11 of this invention which includes rolls 24 and 25. The sheet is then forwarded to the transfer station 26 in proper registration with the image on the drum. The developed image on the photoconductive surface 13 is brought into contact with the sheet 16 of final support material within the transfer station 26 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 27 which coalesces the transferred powder image thereto. One type of suitable fuser is described in U.S. Pat. No. 2,701,765, issued to Codichini, et al. in 1955. After the fusing process the sheet 16 is advanced selectively to a suitable output device such as tray 28 or sorter 29.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 30. The toner particles may be mechanically cleaned from the photoconductive surface 13 by any conventional means as, for example, the use of a blade as set forth in U.S. Pat. No. 3,740,789, issued to Ticknor in 1973.

If desired, a document handling system 31 can be used to advance documents on and off a viewing platen 32.

It is believed that the foregoing description is sufficient for purposes of the present application to illustrate the general operation of an automatic xerographic copier 10 which can embody the apparatus 11 in accordance with the present invention.

A detailed description of a suitable registration mechanism for use in accordance with the present invention can be found by reference to the above-noted Taylor, et al. patent. The present invention relates to an improvement particularly adapted for use with the Taylor, et al. registration apparatus.

Figure 2:
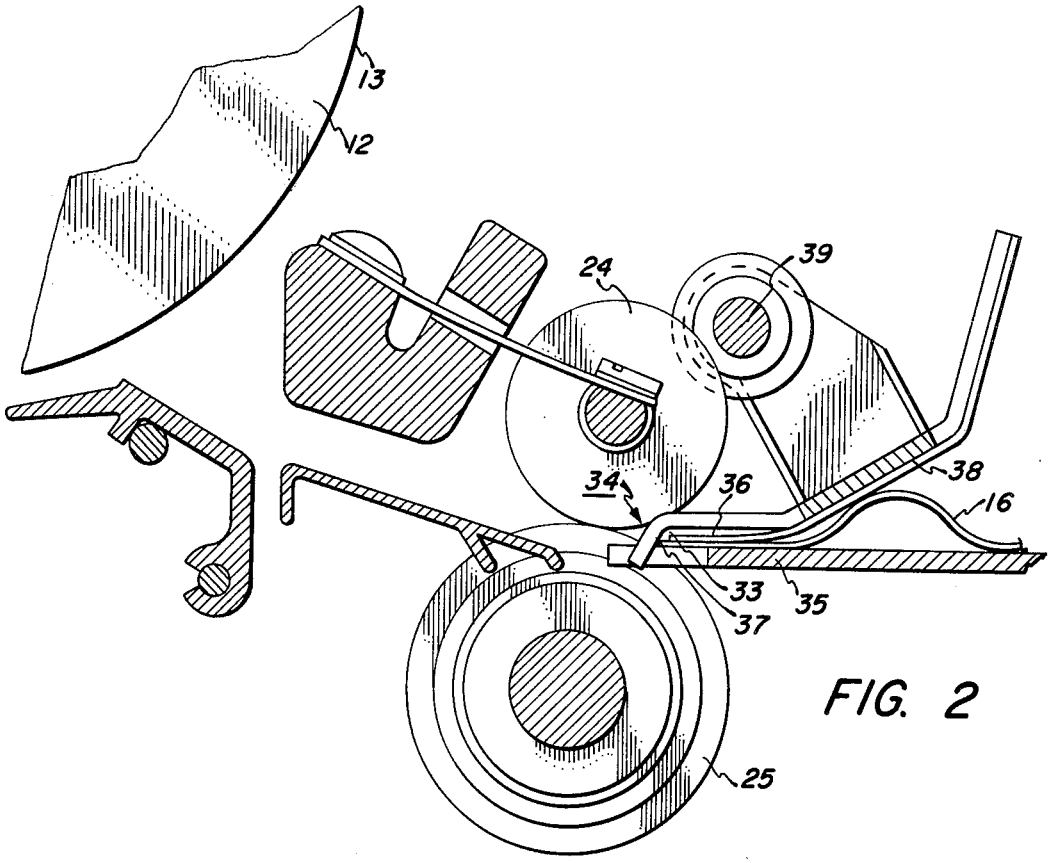
FIG. 2 is a side view showing the registration mechanism in greater detail with the registration gate in sheet blocking relationship.

Referring now to FIG. 2, it has been found that the width of the gap or the throat 33 defined between the registration gate 34 and the guide member 35 adjacent thereto at the point of registration in the Taylor, et al. apparatus was sufficiently wide to allow some variability in the exact position of the edge of the sheet intercepted by the gate. Further, depending upon where the edge of the sheet intercepted the gate, nicking of the sheet edge or other comparable damage could occur.

In order to eliminate this variability and lead edge nicking a means 36 is provided in accordance with the present invention to restrict the throat 33 opening adjacent the registration gate 34 so that each succeeding sheet 16 intercepts the registration gate at essentially the same point on the stop face 37. This is accomplished by providing a resilient member 36, such as a Mylar strip which is adhesively mounted to the chute portion 38 registration gate 34. The resilient member 36 is arranged to overly the lower guide chute or member 35. It is secured to the registration gate 34 so as to extend out toward the stop face 37 of the gate in a cantilevered fashion. The stiffness of the Mylar member 36 and its cantilevered mounting result in its acting like a spring which is biased against the lower guide chute 35 at the registration portion. This restricts the throat 33 of the sheet path at the registration gate 35.

When a sheet 16 is fed to the registration gate 34 the Mylar strip 36 is lifted off of the lower chute 35, and operates upon the sheet to urge it against the lower chute. Therefore, the sheet 16 engages the gate at a position consistently defined by the lower chute 35.

Figure 3:
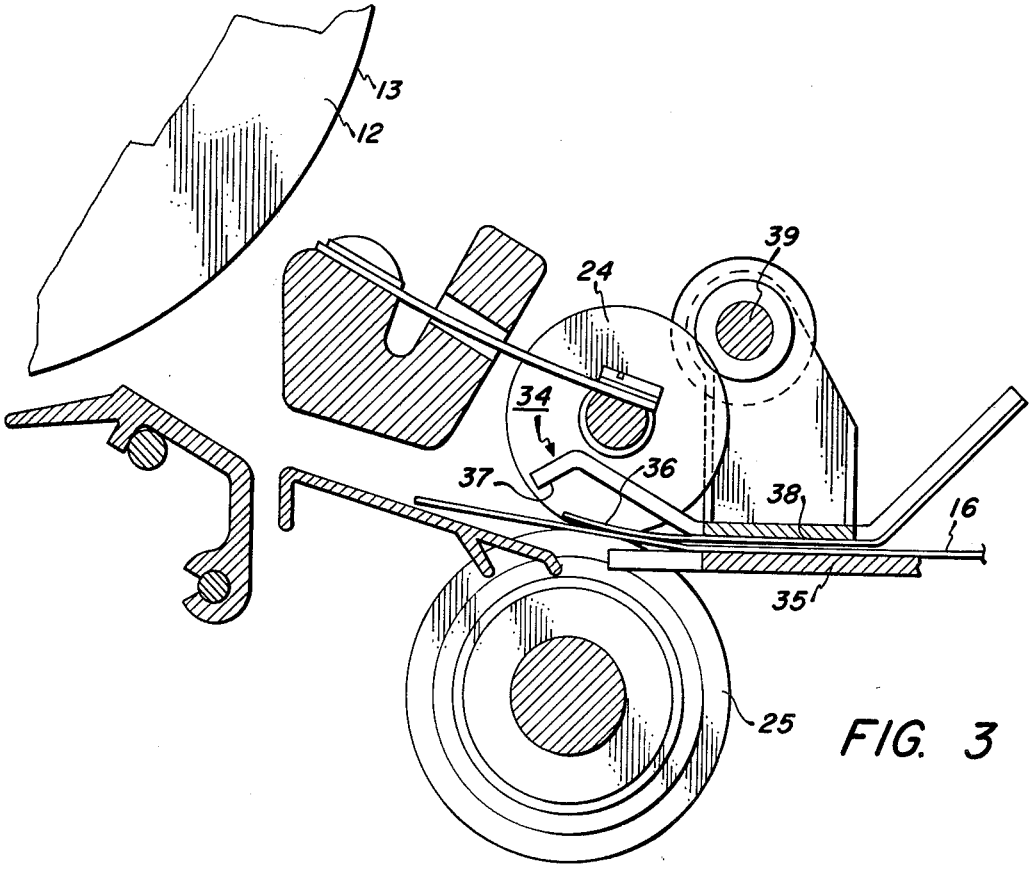
FIG. 3 is a side view showing the registration mechanism in greater detail with the registration gate moved out of sheet blocking relationship.

After the registration sequence has been completed and the registration gate 34 moves out of its sheet blocking position, as in FIG. 3, the cantilever mounting of the Mylar strip 36 causes the free end of the strip adjacent the stop face 37 to move away from the stop face and thereby aid in stripping the sheet from the stop face as it is fed into the transfer station 26. The registration gate 34 has been designed as in the Taylor, et al. patent so that the sheet 16 strips from the stop face 37 as the gate pivots about shaft 39 in coordination with the movement of the sheet, namely, in the direction of sheet movement, to deliver the sheet into the nip of the registration rolls 24 and 25.

The throat control member 36 in accordance with this invention provides a dual function. It aids in stripping a sheet from the gate 34 thereby preventing a sheet from hanging up on the stop face 37 and jamming in the machine. It also restricts the throat 33 or opening in the sheet path at the registration position.

In the embodiment which has been shown, the Mylar strip 36 extends completely across the registration gate 34 from side-to-side thereof. It comprises a unitary spring-like member having a plurality of fingers extending out in cantilevered fashion in correspondence with the fingers of the registration gate 34 of Taylor, et al.. If desired, however, the stripper assist and throat control means 36 in accordance with this invention can comprise a plurality of spring-like members attached to the registration gate in spaced apart fashion. The specific shape of the stripper assist and throat control means of this invention may be selected as desired.

While the invention has been described with reference to an embodiment wherein the registration gate 34 and stripper assist and throat control means 36 are supported above the sheet path, if desired, they could be supported below the sheet path and the sheet urged against an upper chute or guide member 35.

The stripper assist and throat control means 36 also operates to decelerate the sheet 16 as it approaches the stop face 37 thereby reducing the occurrence of lead edge nicking of the sheet.

The patents and texts referred to specifically in detailed description of this application are intended to be incorporated by reference into the description.

It is apparent that there has been provided in accordance with this invention a registration system for a reproducing machine which fully satisfies the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a reproducing apparatus comprising;

means for forming an image on a sheet;

means for propelling a sheet along a path to said image forming means;

means for registering the sheet with respect to said image forming means, said registering means comprising: a stop member for intercepting an edge of said sheet, said stop member including a stop face and a chute portion; and means for moving said stop member either into sheet blocking relationship in said path, or out of said sheet blocking relationship; and a guide member for supporting said sheet along said path at a position adjacent said stop member; the improvement wherein, said registering means further includes:

a resilient means for urging said sheet against said guide member as it is intercepted by said stop face, said resilient member being mounted to said chute portion of said stop member with a free end thereof adjacent said stop face (means).

2. An apparatus as in claim 1, wherein said resilient means is also operative to strip a sheet from said stop member as it is moved out of said sheet blocking relationship.

3. An apparatus as in claim 2, wherein said means for moving said stop member comprises; means for pivotally supporting said stop member so that when said stop member moves out of said sheet blocking position, it moves in a direction in which said sheet is being propelled.

4. An apparatus as in claim 2, wherein said resilient means comprises a resilient member mounted in cantilevered fashion to said stop member.

5. An apparatus as in claim 1, wherein said resilient member comprises a strip-like member.

6. An apparatus as in claim 5, wherein said guide member is positioned below said sheet and wherein said stop and resilient members are arranged above said sheet.

7. An apparatus as in claim 6, wherein said means for forming an image on said sheet comprises: an imaging surface arranged for movement; means for forming an electrostatic image on said imaging surface; means for developing said electrostatic image to render it visible; and means for transferring said visible image to said sheet, and wherein said registering means is arranged to position said sheet along said path in a timed relationship with respect to said transferring means.

8. An apparatus as in claim 1, wherein said resilient means is also operative to decelerate said sheet as it approaches said stop member.

* * * * *